US009993049B2

(12) United States Patent
Miyazaki et al.

(10) Patent No.: US 9,993,049 B2
(45) Date of Patent: Jun. 12, 2018

(54) SLIDE FASTENER SLIDER

(71) Applicant: YKK Corporation, Tokyo (JP)

(72) Inventors: Yohei Miyazaki, Toyama (JP); Keiichi Keyaki, Toyama (JP)

(73) Assignee: YKK Corporation (JP)

( * ) Notice: Subject to any disclaimer, the term of this patent is extended or adjusted under 35 U.S.C. 154(b) by 86 days.

(21) Appl. No.: 14/904,124

(22) PCT Filed: Jul. 11, 2013

(86) PCT No.: PCT/JP2013/068932
§ 371 (c)(1),
(2) Date: Jan. 11, 2016

(87) PCT Pub. No.: WO2015/004763
PCT Pub. Date: Jan. 15, 2015

(65) Prior Publication Data

US 2016/0143401 A1 May 26, 2016

(51) Int. Cl.
*A44B 19/30* (2006.01)
*A44B 19/42* (2006.01)
*A44B 19/26* (2006.01)

(52) U.S. Cl.
CPC ..... *A44B 19/306* (2013.01); *A44B 19/262* (2013.01); *A44B 19/308* (2013.01); *A44B 19/42* (2013.01)

(58) Field of Classification Search
CPC ..... A44B 19/306; A44B 19/262; A44B 19/42; A44B 19/308
See application file for complete search history.

(56) References Cited

U.S. PATENT DOCUMENTS 2,322,826 A * 6/1943 Carlile ..... A44B 19/306 24/421
3,068,542 A 12/1962 Firing
(Continued)

FOREIGN PATENT DOCUMENTS

JP 10-099107 A 4/1998
JP 2002-315609 A 10/2002
(Continued)

OTHER PUBLICATIONS

International Search Report, PCT Application No. PCT/JP2013/068932, dated Oct. 15, 2013.
(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

There is provided a slide fastener slider. A pull tab has a rotatable region including laid-down positions and a stood-up position. Within the rotatable region of the pull tab, a locking pawl is elastically deformed to move a cover portion, and a pawl portion is arranged to be inserted into and removed from an element guide passage in accordance with movement of the cover portion. When the pull tab is completely laid down toward the shoulder mouths and rear mouth relative to the slider body, the pull tab has respective regions in which the pull tab is rotatable over a predetermined angle without exerting any load on the locking pawl.

9 Claims, 7 Drawing Sheets

(56) References Cited

U.S. PATENT DOCUMENTS

| | | | | |
|---|---|---|---|---|
| 3,133,328 | A | 5/1964 | Huelster | |
| 3,262,172 | A * | 7/1966 | Scheuerman | A44B 19/306 24/421 |
| 3,355,778 | A * | 12/1967 | Elsenheimer | A44B 19/306 24/421 |
| 4,391,022 | A | 7/1983 | Oda | |
| 5,896,628 | A | 4/1999 | Oda | |
| 8,584,326 | B2 * | 11/2013 | Keyaki | A44B 19/306 24/420 |
| 8,782,857 | B2 * | 7/2014 | Keyaki | A44B 19/306 24/421 |
| 8,782,858 | B2 * | 7/2014 | Keyaki | A44B 19/306 24/419 |
| 8,966,720 | B2 * | 3/2015 | Miyazaki | A44B 19/26 24/415 |
| 9,271,548 | B2 * | 3/2016 | Keyaki | A44B 19/306 |
| 2002/0152591 | A1 | 10/2002 | Nagata et al. | |
| 2011/0197403 | A1 * | 8/2011 | Keyaki | A44B 19/306 24/418 |
| 2011/0258818 | A1 | 10/2011 | Keyaki et al. | |
| 2013/0174387 | A1 * | 7/2013 | Hamada | A44B 19/306 24/418 |
| 2013/0185904 | A1 * | 7/2013 | Ozawa | A44B 19/306 24/418 |

FOREIGN PATENT DOCUMENTS

| | | | |
|---|---|---|---|
| JP | 2013-031691 | A | 2/2013 |
| TW | I371248 | B1 | 9/2012 |
| TW | I383757 | B1 | 2/2013 |
| WO | 2009/130771 | A1 | 10/2009 |
| WO | 2010/070744 | A1 | 6/2010 |
| WO | 2011/061815 | A1 | 5/2011 |
| WO | 2013/011592 | A1 | 1/2013 |

OTHER PUBLICATIONS

International Preliminary Report on Patentability, PCT International Patent Application No. PCT/JP2013/068932, dated Jan. 12, 2016.

Office Action, Taiwanese Patent Application No. 103123859, dated Sep. 17, 2015.

Office Action, Japanese Patent Application No. 2015-526087, dated Aug. 24, 2016.

* cited by examiner

SLIDE FASTENER SLIDER

This application is a national stage application of PCT/JP2013/068932, which is incorporated herein by reference.

TECHNICAL FIELD

The present invention relates to a slide fastener slider on which a surface treatment is performed, and in particular a slide fastener slider in which a poor surface treatment can be reduced.

BACKGROUND ART

Conventionally, as sliders used for slide fasteners, there is known a slider having an automatic stop mechanism, in which when operation of a pull tab is stopped after a slide fastener is opened or closed, a locking pawl mounted on the slider is automatically operated to keep the slider at a stopped position and also such a sliding-stopped state of the slider can be kept as far as the pull tab is no longer operated. Also, a specific example of the slider having such an automatic stop mechanism is disclosed from Japanese Patent Application Publication No. 2013-31691 (Patent Document 1) and the like.

For example, a slider disclosed from Patent Document 1 is provided, on an upper blade thereof, with an insertion groove allowing a locking pawl to be inserted therein, a pawl hole provided on a rear mouth-side end edge portion of the upper blade to extend from an upper surface of the upper blade to an element guide passage, crimping protrusions erected on both right and left sides of the insertion groove in a front end portion of the upper blade, and right and left pull tab holding portions for holding a pull tab.

Also, the locking pawl according to Patent Document 1 has a pawl portion arranged on one end of the locking pawl to be inserted through the pawl hole of the slider body, a hook portion arranged on the other end of the locking pawl to be fitted into the insertion groove of the slider body, and a cover portion provided between the pawl portion and the hook portion to cover a connection rod of the pull tab.

In addition, the pull tab of Patent Document 1 have has a pull tab body, right and left arm portions provided to extend from the pull tab body, and a circular columnar-shaped connection rod connecting leading ends of the right and left arm portions. Also, in the middle of the connection rod in a right and left direction, a recessed portion is formed to cause a cross section of the connection rod to become a half circular shape.

Also, in Patent Document 1, when the pull tab and the locking pawl as described above are mounted on the slider body, the connection rod of the pull tab is first inserted into the pull tab holding portions and then the pull tab holding portions are crimped, thereby pivotally holding the pull tab on the slider body. Subsequently, the locking pawl is inserted into the insertion groove of the slider body with the pull tab held thereon, while being positioned to allow the pawl portion to be inserted though the pawl hole of the slider body. Therefore, the locking pawl is positioned at a predetermined position on the slider body.

Then, by crimping the protrusions of the slider body, the other end of the locking pawl is fixed in a crimping manner while having a predetermined clearance. In this way, the slider of Patent Document 1 is assembled.

In the case of the slider of Patent Document 1 assembled as described above, when the pull tab is laid down toward the rear mouth, the cover portion of the locking pawl is fitted into the recessed portion of the pull tab, and a position of the locking pawl relative to the slider body descends. Accordingly, the pawl portion of the locking pawl is inserted into the element guide passage though the pawl hole of the slider body.

Contrarily, when the pull tab is stood up or laid down toward the front end side of the slider, the cover portion of the locking pawl is lifted by pivoting of the connection rod of the pull tab, so that the pawl portion of the locking pawl is removed from the element guide passage. In this case, the other end of the locking pawl is kept fixed while having the predetermined clearance as described above. Accordingly, when the pull tab is operated to be laid down or stood up, the other end of the locking pawl is allowed to be moved in the insertion groove due to the clearance, and thus operations of inserting and removing the pawl portion into and from the element guide passage can be smoothly performed.

Therefore, when a slide fastener is constructed using the slider, for example, if operation of the pull tab is stopped and then the pull tab is laid down toward the rear mouth, the pawl portion of the locking pawl can protrude into the element guide passage and thus can be engaged with element rows. Accordingly, the slider is stopped relative to the element rows and also the stopped position can be kept. Contrarily, if the pull tab is stood up for the purpose of operating the slider, the pawl portion is removed from the element guide passage and thus the pawl portion and the element rows are disengaged, thereby allowing the slider to be smoothly slid along the element rows.

PRIOR ART DOCUMENT

Patent Document

Patent Document 1: Japanese Patent Application Publication No. 2013-31691

Patent Document 2: U.S. Pat. No. 4,391,022

SUMMARY OF INVENTION

Problems to Be Solved by Invention

As described above, the slider described in Patent Document 1 is provided with crimping protrusions or fixation portions for fixing the locking pawl to the front end portion of the slider body. Accordingly, after the locking pawl is inserted and arranged in the insertion groove of the upper blade, the crimping portions are crimped or the fixation portions are fixed at predetermined positions on the upper blade. Thus, the locking pawl can be fixed on the upper blade of the slider body while allowing the pawl portion of the locking pawl to be inserted into and removed from the element guide passage.

However, in the case where the locking pawl and the pull tab are fixed on the upper blade of the slider body as described above, if a surface treatment, such as plating or painting, is performed after the locking pawl and the pull tab are assembled on the body, a surface treatment material cannot permeate into regions where the pull tab is in close contact with the body as the pull tab is urged against the body due to an elastic force of a spring of the locking pawl. The surface treatment is likely to be difficult to be performed.

Therefore, in the case of the slider having such a structure, the surface treatment is first performed in a state where the body and the pull tab are assembled, and then the locking pawl is assembled. Thus, in order to assemble the slider, a process of mounting the pull tab on the slider body and a process of mounting the locking pawl on the slider body have to be separately performed. As a result, costs are incurred to purchase respective equipment for performing each individual process, spaces are required to dispose the respective equipment, and also additional working hours are taken for each individual process.

In addition, the locking pawl is configured not to be subjected to a surface treatment. Accordingly, because in the assembled slider, the locking pawl has an appearance from those of the body and the pull tab, there is a room for improvement in terms of decorativeness.

The present invention has been made keeping in mind the above problems, and a specific object thereof is to provide a slide fastener slider, in which assembling processes of a slider body, a locking pawl and a pull tab can be integrally and quickly performed to save spaces for required equipment and to reduce costs due to shortened working hours, and also decorativeness can be enhanced.

Means for Solving Problems

According to the present invention, there is provided a slide fastener slider, including:

a slider body in which upper and lower blades are connected at front ends thereof to each other by a connecting post and a Y-shaped element guide passage is arranged between the upper and lower blades to extend from shoulder mouths located at a side of the connecting post to a rear mouth located at a side opposite to the connecting post;

a pull tab having a body for operating the slider body, a pair of arm portions provided to extend from one end of the body and a connection rod for connecting the pair of the arm portions; and a locking pawl arranged on the upper blade and having a pawl portion at one end thereof and a cover portion provided between the one end and the other end to cover at least a part of the connection rod of the pull tab, wherein the pull tab is pivotally held on the upper blade at the connecting rod thereof;

wherein the locking pawl is fixed on the slider body at the other end thereof;

wherein the pull tab has a rotatable region including laid-down positions where the pull tab is laid down toward the shoulder mouths and rear mouth of the slider body, and a stood-up position where the pull tab is stood up from the laid-down positions by pivotal operation of the connection rod, wherein, within the rotatable region of the pull tab, the locking pawl is elastically deformed to move the cover portion, and the pawl portion is arranged to be inserted into and removed from the element guide passage in accordance with movement of the cover portion, and wherein when the pull tab is completely laid down toward the shoulder mouths and rear mouth relative to the slider body, the pull tab has respective regions in which the pull tab is rotatable over a predetermined angle without exerting any load on the locking pawl.

Also, in the slide fastener slider according to the present invention, the connection rod of the pull tab has a cam portion formed to protrude from a base end side thereof toward a leading end side;

wherein the cam portion has first and second inclined surfaces, respectively, on front and back sides of the pull tab;

wherein the first and second inclined surfaces are inclined in such a direction that the inclined surfaces approach each other from the base end side toward the leading end side;

wherein when the pull tab is completely laid down toward the rear mouth relative to the slider body, the predetermined angle is formed between the first inclined surface of the cam portion and a lower surface of a top plate portion of the cover portion of the locking pawl; and wherein when the pull tab is completely laid down toward the shoulder mouths relative to the slider body, the predetermined angle is formed between the second inclined surface of the cam portion and the lower surface of the top plate portion of the cover portion of the locking pawl.

Further, in the slide fastener slider according to the present invention, the cam portion is configured to have a circular arc-shaped leading end portion connecting the first and second inclined surfaces; and wherein the cam portion is formed so that a straight line, which passes through a rotational center of the base end side of the cam portion and extends in a longitudinal direction of the pull tab, and a straight line, which passes through a radial center of the leading end side of the cam portion and the rotational center of the base end side thereof, are intersected with each other.

Further, in the slide fastener slider according to the present invention, a mounting portion having an upper surface positioned above the upper surface of the upper blade is formed on the upper surface of the upper blade; and wherein the connection rod of the pull tab is installed on the slider body to be abutted against the upper surface of the mounting portion.

Further, in the slide fastener slider according to the present invention, stepped portions having a stepped surface are formed on respective side ends of the upper surface of the upper blade, which are located toward the rear mouth;

wherein the stepped portions are configured to have a stepped bottom surface positioned below the upper surface of the upper blade; and wherein when the pull tab is laid down toward the rear mouth, the pull tab and the slider body have a relationship that the pull tab is abutted against the upper surface of the upper blade and gaps between the stepped bottom surfaces and the pull tab are created.

Further, in the slide fastener slider according to the present invention, at the laid-down position where the pull tab is completely laid down toward the rear mouth relative to the slider body, the angle $\alpha$ between the first inclined surface of the cam portion and the lower surface of the top plate portion of the cover portion of the locking pawl is $10° < \alpha \leq 35°$; and wherein at the laid-down position where the pull tab is completely laid down toward the shoulder mouths relative to the slider body, the angle $\beta$ between the second inclined surface of the cam portion and the lower surface of the top plate portion of the cover portion of the locking pawl is $10° < \beta \leq 35°$.

Further, in the slide fastener slider according to the present invention, the pull tab is configured to be rotatable relative to the slider body within a range of 0° or more and 5° or less from a stoop-up position, where a longitudinal direction of the pull tab is parallel to the upper surface of the upper blade, toward the respective laid-down positions.

Further, in the slide fastener slider according to the present invention, the slider body, the pull tab and the locking pawl have surfaces subjected to the same surface treatment.

In addition, according to the present invention, there is a method of manufacturing a slide fastener slider, the slide fastener slider including:

a slider body in which upper and lower blades are connected at front ends thereof to each other by a connecting post and a Y-shaped element guide passage is arranged between the upper and lower blades to extend from shoulder mouths located at a side of the connecting post to a rear mouth located at a side opposite to the connecting post;

a pull tab having a body for operating the slider body, a pair of arm portions provided to extend from one end of the body and a connection rod for connecting the pair of the arm portions; and a locking pawl arranged on the upper blade and having a pawl portion at one end thereof and a cover portion provided between the one end and the other end to cover at least a part of the connection rod of the pull tab, wherein the pull tab has a rotatable region including laid-down positions where the pull tab is laid down toward the shoulder mouths and rear mouth of the slider body, and a stood-up position where the pull tab is stood up from the laid-down positions by pivotal operation of the connection rod, the method comprising:

a mounting step of mounting the pull tab and the locking pawl on the slider body, so that within the rotatable region of the pull tab, the pull tab has:

a first rotatable region in which the locking pawl is elastically deformed to move the cover portion;

a second rotatable region between the first rotatable region and the laid-down position toward the shoulder mouths, where the pull tab is rotatable over a predetermined angle without exerting any load on the locking pawl; and a third rotatable region between the first rotatable region and the laid-down position toward the rear mouth, where the pull tab is rotatable over a predetermined angle without exerting any load on the locking pawl; and a surface treatment step of surface-treating the slide fastener slider having the slider body, the pull tab and the locking pawl mounted during the mounting step.

Advantageous Effects of Invention

According to the slide fastener slider of the present invention, a slide fastener slider can be provided, in which assembling processes of a slider body, a locking pawl and a pull tab can be integrally and quickly performed to save spaces for required equipment and to reduce costs due to shortened working hours, and also decorativeness can be enhanced.

EMBODIMENTS OF INVENTION

Now, embodiments of the present invention will be described in detail with reference to the accompanying drawings.

Figure 1:
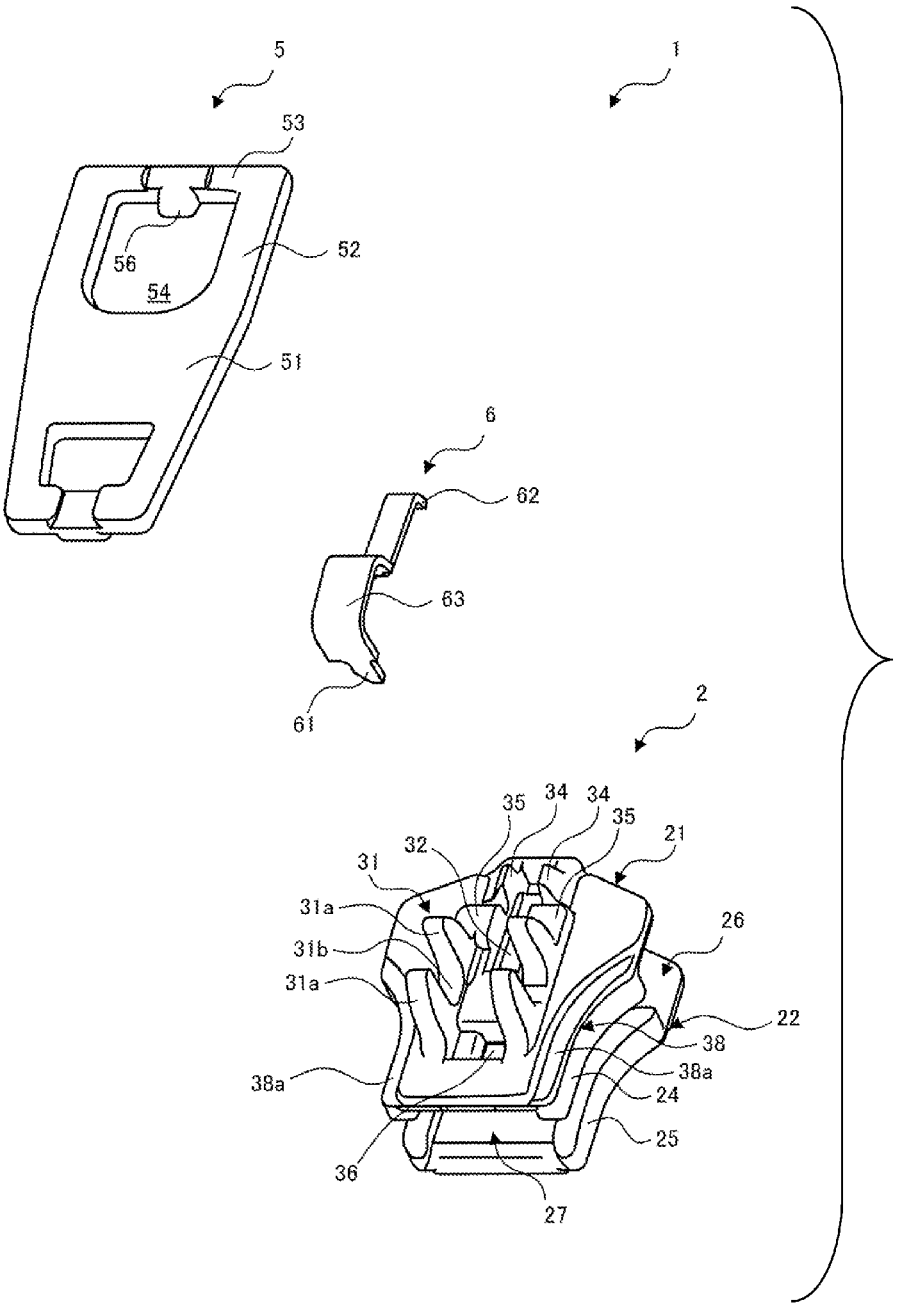
FIG. 1 is a perspective view showing an exploded state of components according to a slide fastener slider of the present embodiment.
Figure 2:
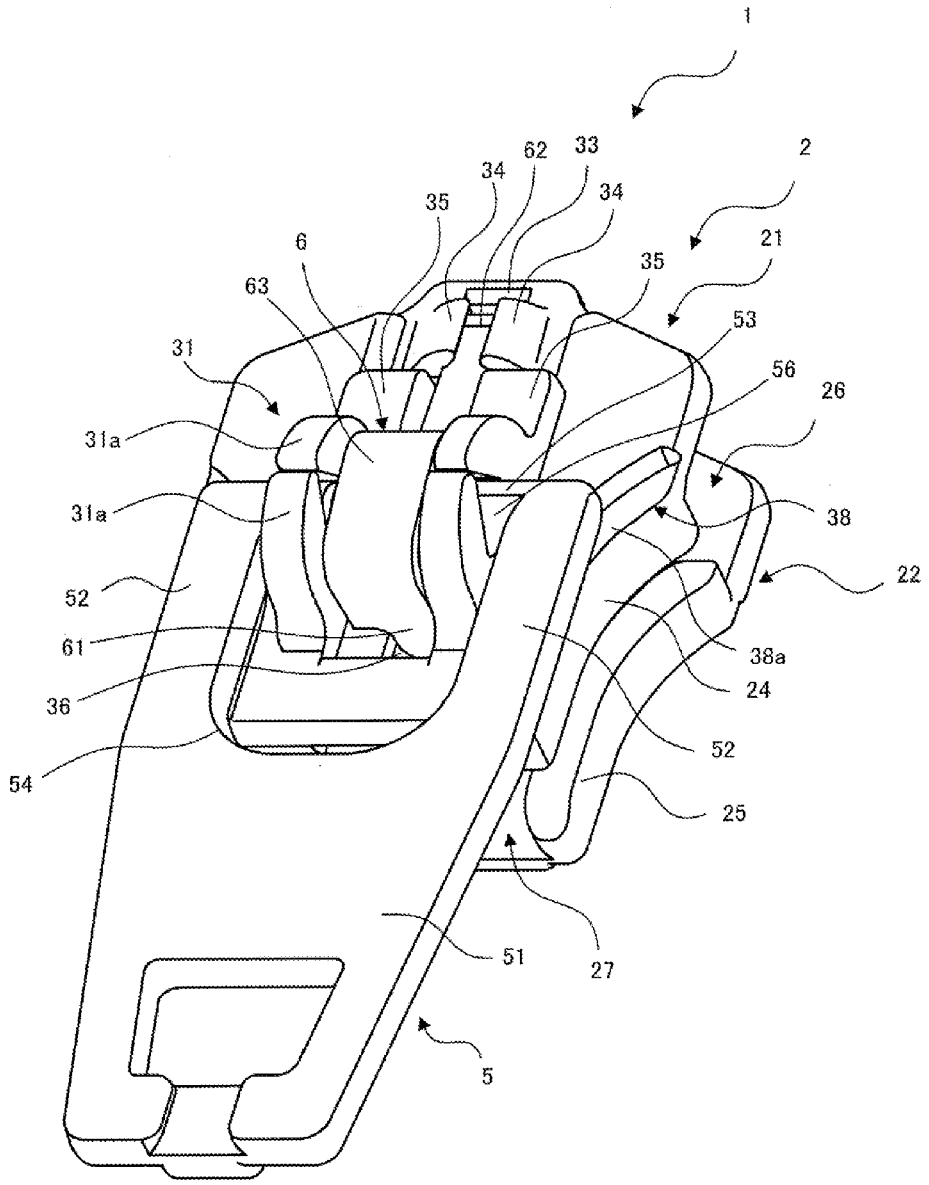
FIG. 2 is a perspective view showing an assembled state of the slider of the present embodiment.
Figure 3:
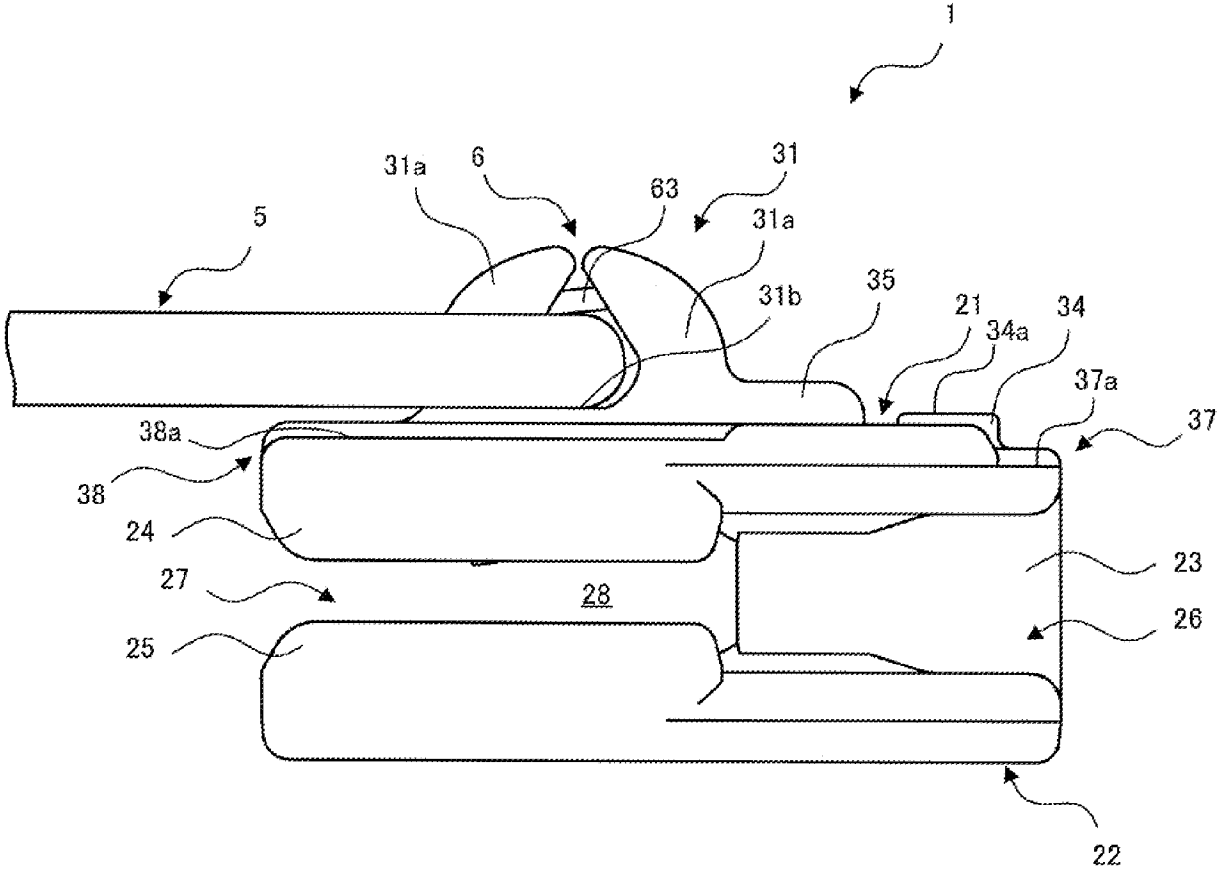
FIG. 3 is a side view showing a state where a pull tab is laid down toward a rear mouth to be parallel to an upper surface of an upper blade thereof according to the slider of the present embodiment.
Figure 4:
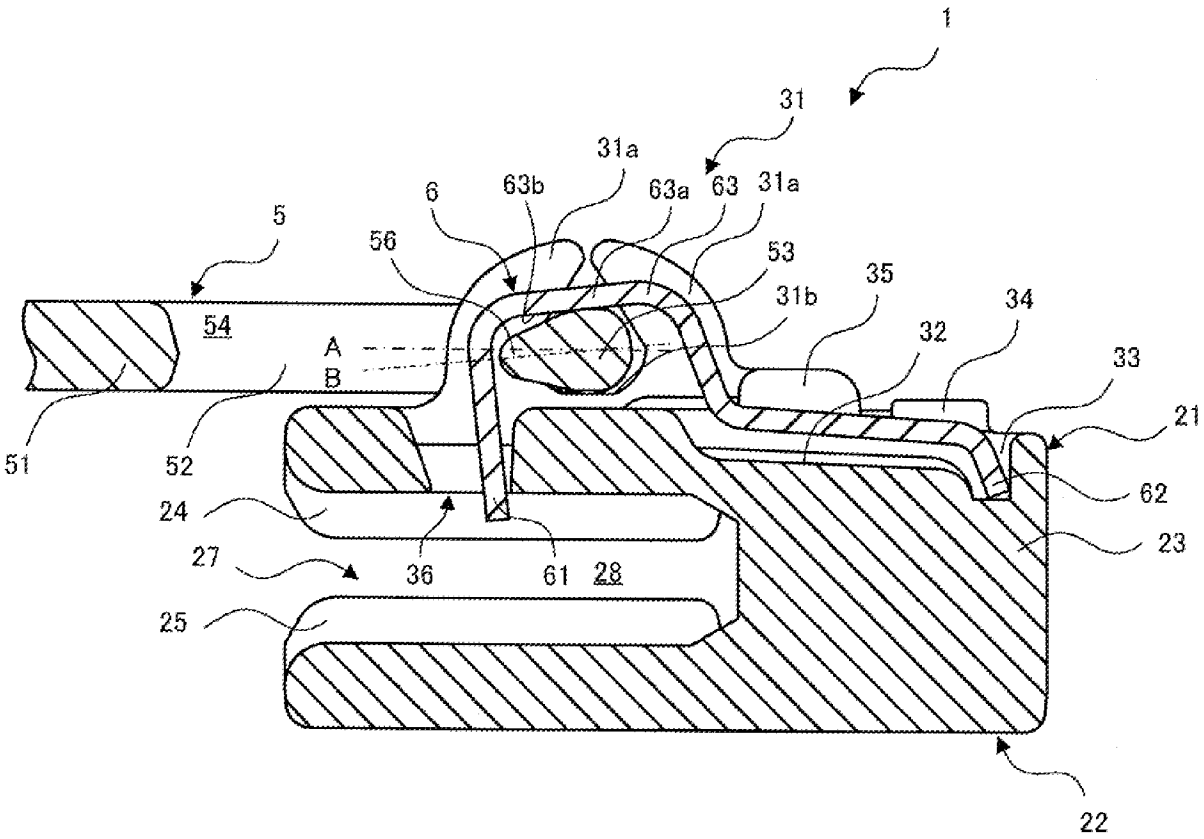
FIG. 4 is a sectional view, as taken along a front and rear direction, showing a state where the pull tab is laid down toward the rear mouth to be parallel to the upper surface of the upper blade according to the slider of the present embodiment.
Figure 5:
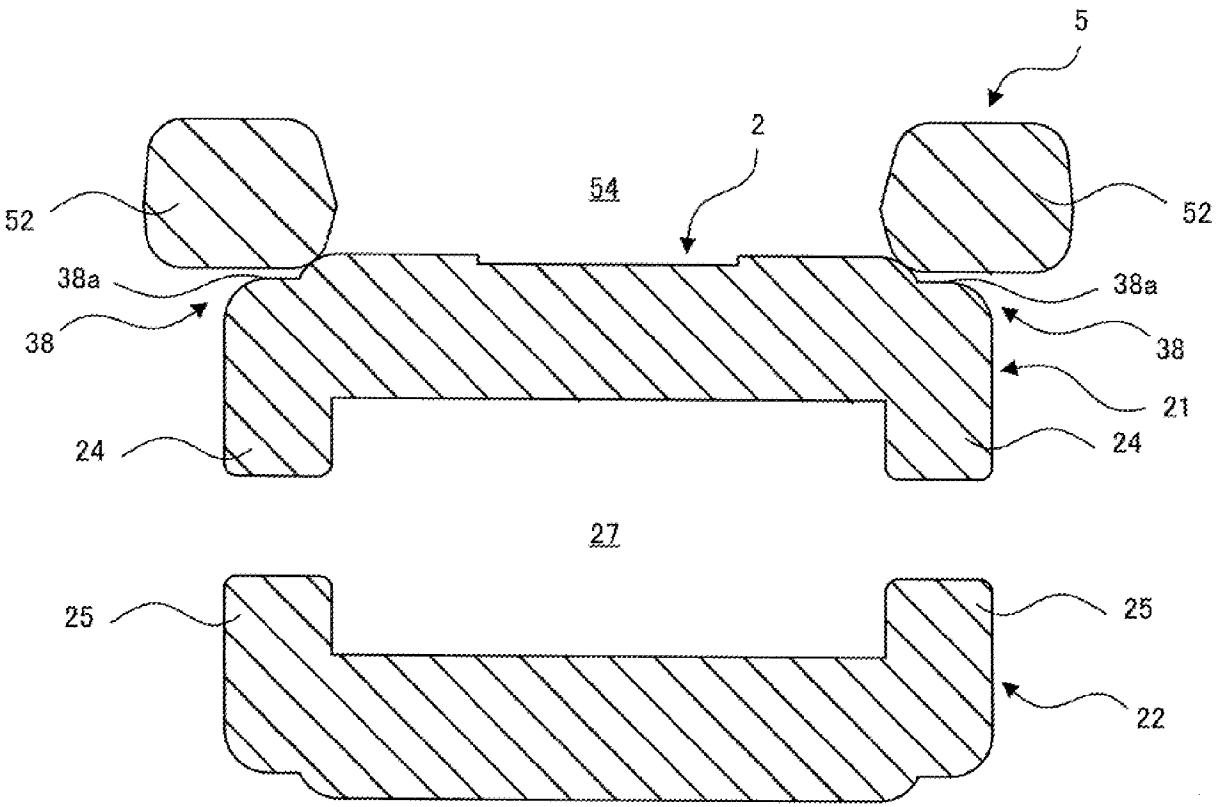
FIG. 5 is a sectional view, as taken along a right and left direction, showing a state where the pull tab is completely laid down toward the rear mouth according to the slider of the present embodiment.

FIG. 1 is a perspective view showing an exploded state of components according to a slide fastener slider of the present embodiment. FIG. 2 is a perspective view showing an assembled state of the slider of the present embodiment. FIG. 3 is a side view showing a state where a pull tab is laid down toward a rear mouth to be parallel to an upper surface of an upper blade thereof according to the slider of the present embodiment. FIG. 4 is a sectional view, as taken along a front and rear direction, showing a state where the pull tab is laid down toward the rear mouth to be parallel to the upper surface of the upper blade according to the slider of the present embodiment. FIG. 5 is a sectional view, as taken along a right and left direction, showing a state where the pull tab is completely laid down toward the rear mouth according to the slider of the present embodiment.

Meanwhile, with respect the slide fastener slider 1 according to the present invention, a front direction refers to a direction along which the slider 1 is slid to engage element rows with each other, and a rear direction refers to a direction along which the slider is slid to disengage the element rows from each other. Also, an upward and downward direction refers to a direction perpendicular to upper and lower blades 21 and 22, and a right and left direction refers to a direction parallel to the upper and lower blades 21 and 22 and also perpendicular to the sliding direction of the slider 1.

As shown in FIG. 1, the slider 1 according to the present embodiment includes a slider body 2, a pull tab 5 pivotally held on the slider body 2 at one end thereof, and a locking pawl 6 arranged on the slider body 2. According to the slider 1 of the present embodiment, the slider body 2 and the pull tab 5 is made of metal materials, such as aluminum alloy, zinc alloy or copper alloy, by die-casting or pressing. Also, the locking pawl 6 is made of a high elasticity metal material, such as stainless steel or copper alloy, by pressing.

The slider body 2 has an upper blade 21, a lower blade 22 and a connecting post 23 for connecting front ends of the upper and lower blades 21 and 22. Upper flange portions 24 are suspended from right and left sides of the upper blade 21 in a direction perpendicular the upper blade 21, and lower flange portions 25 are erected form right and left sides of the lower blade 22 in a direction perpendicular to the lower blade 22.

Also, the slider body 2 has shoulder mouths 26 arranged on both right and left sides of the connecting post 23, a rear mouth 27 arranged on a rear end thereof, and a Y-shaped element guide passage 28 formed between the upper and lower blade 21 and 22 for connecting the right and left shoulder mouths 26 with the rear mouth 27.

The upper blade 21 of the slider body 2 has right and left pull tab holding portions 31 for pivotally holding one end of the pull tab 5, an insertion groove 32 arranged in the middle of an upper surface of the upper blade 21 in the right and left direction and configured to allow the locking pawl 6 to be inserted therein, a recessed portion 33 provided concavely in an front end of the upper blade 21, a pair of right and left fixation portions 34 erected from a bottom surface of the recessed portion 33, and raised portions arranged on both right and left sides of the insertion groove 32 and also between the pull tab holding portions 31 and the recessed portion 33 and raised from the upper surface of the upper blade 21.

Meanwhile, as described below, the fixation portions 34 are crimped in directions approaching each other to fix the locking pawl 6 to the slider body 2, but the fixation may not be necessary to be performed by crimping. For example, as representatively disclosed in FIGS. 3 and 4 of Patent Document 2, the locking pawl may be fixed by elastically engaging a leading end of the locking pawl with a fixation portion formed on an inner wall of a hole provided in the guide post.

The pull tab holding portions 31 each includes a pair of front and rear protrusions 31*a* formed to protrude on the respective right and left sides of the insertion hole 32 at a location which is located toward the rear mouth 27, and a mounting portion 31*b* configured to allow a part of the pull tab 5 to be mounted between the right and left protrusions 31*a*. A connection rod 53, as described below, of the pull tab 5 can be pivotally held on the pull tab holding portions 31, by inserting the connection rod 53 of the pull tab 5 between the front and rear protrusions 31*a* to be mounted in the mounting portion 31*b* and then bending and crimping the pair of front and rear protrusions 31*a* in direction approaching each other. Meanwhile, the mounting portion 31*b* has an upper surface raised above the upper surface of the upper blade 21 and a part of the connection rod 53 of the pull tab 5 is mounted on the upper surface of the mounting portion 31*b*.

The insertion groove 32 has a groove width equal to or slightly larger than a dimension of the locking pawl 6 in the right and left direction, thereby allowing the locking pawl 6 to be stably inserted therein. Also, at a location in the insertion groove 32, which is located toward the rear mouth 27, a step corresponding to a shape of the locking pawl 6 is provided in a stepwise manner in a longitudinal direction of the insertion groove 32.

The recessed portion 33 is provided concavely on an upper surface side of the insertion groove 32 at a front end portion of the upper blade 21 to which the connecting post 23 is connected. A hook portion 62 of the locking pawl 6 is abutted and supported against the recessed portion 33.

The fixation portions 34 in the slider 1 of the present embodiment are erected from a bottom surface of the upper blade 21. The right and left fixation portions 34 are bent and crimped inward after the locking pawl 6 is inserted into the insertion groove 32 of the upper blade 21.

The raised portions 35 are arranged to project from the upper surface of the upper blade 21 on both right and left sides of the insertion groove 32. By arranging the raised portions 35 in this way, the locking pawl 6 can be less visibly concealed by the raised portions 35 in the right and left direction to prevent the locking pawl 6 from protruding upward from the inside of the insertion groove 32, for example, even if a part of the locking pawl 6 is moved upward above the upper surface of the upper blade 21 when the locking pawl 6 is arranged in the insertion groove 32 and also the locking pawl 6 is moved upward or downward inside the insertion groove 32 by operation of the pull tab 5, thereby improving appearance of the slider 1.

Also, at a location on the slider 1 which is located between the right and left pull tab holding portions 31 and also toward the rear mouth 27, a pawl hole 36 is provided to allow a pawl portion 61, as described below, of the locking pawl 6 to be inserted therethrough when the locking pawl 6 is arranged in the insertion groove 32.

Also, as shown in FIG. 3, a first stepped portion 37 having a first stepped surface 37*a* at a height location between the upper surface of the upper blade 21 and the bottom surface of the recessed portion 33 is formed on a portion surrounding a front half of the recessed portion 33.

Further, second stepped portions 38 having a stepped bottom surface 38*a* are formed on an upper surface of an area of the upper blade 21, which is located toward the rear mouth 27 and in which the upper flange portions 24 are formed. The second stepped portions 38 have the stepped bottom surface 38 formed to be positioned below the upper surface 21, and in a case where the pull tab 5 is completely laid down toward the rear mouth 27 as shown in FIG. 5, the pull tab 5 and the slider body 2 are abutted against each other at the second stepped portions 38. At this time, the abutted portions between the pull tab 5 and the slider body 2 are spot-contacted or line-contacted with each other at chamfered portions of corners, which are located toward the second stepped portions 38, of the upper surface of the upper blade 21 and thus gaps are formed between the stepped bottom surfaces 38*a* and the pull tab 5.

By forming such spaces, a surface treatment material can easily permeate into the spaces during a surface treatment presses as described below, thereby reducing a poor surface treatment. Also, because the connection rod 53 is mounted in the mounting portions 32*b* formed on the upper blade 21 and also the pull tab 5 is abutted against the chambered portions of the upper surface of the upper blade 21, the pull tab 5 can be arranged to be inclined downward from the mounting portions 31*b* toward the second stepped portions 28 when the pull tab 5 is laid down toward the rear mouth 27.

The pull tab 5 according to the present embodiment has a pull tab body 51, right and left arm portions 52 provided to extend from one end of the pull tab body 51 in parallel to each other, and the connection rod 53 connecting leading ends of the right and left arm portions 52. Also, in the middle portions of front and back surfaces of the pull tab body 51, a rectangular opening window portion 54 is provided to extend therethrough in a front and back direction thereof. The opening window portion 54 is formed to allow protrusions 31*a*, which are formed further toward the rear mouth, of the above protrusions 31*a*, to pass therethrough when the pull tab 5 is laid down toward the rear mouth 27 and the shoulder mouths 26.

The connection rod 53 of the pull tab 5 is formed in a circular columnar shape to have a circular cross section, and a cam portion 56 is integrally provided on the middle of the connection rod 53 to protrude into an opening defined by the connection rod 53, the right and left arm portions 52 and an one end edge of the pull tab body 51.

The cam portion 56 has a base end side located toward a shaft portion and a leading end side remotest from the shaft portion. The cam portion 56 has a first inclined surface 56*a* located toward the front surface of the pull tab 5 and a second inclined surface 56*b* located toward the back surface, and the first and second inclined surfaces 56*a* and 56*b* are inclined in such a direction that inclined surfaces approach each other from the base end side toward the leading end side. Also, when the pull tab 5 is completely laid down toward the rear mouth 27 and the shoulder mouths 26 relative to the slider body 2, a predetermined angle in the upward and downward direction can be formed between the first and second inclined surfaces 56*a* and 56*b* of the cam portion 56 and a lower surface 63*b* of a top plate portion 63*a* of a cover portion 63, as described below, of the locking pawl 6. In addition, the cam portion 56 is configured to have a circular arc-shaped leading end portion connecting the first and second inclined surfaces 56*a* and 56*b*, and also is formed so that a straight line A, which passes through a rotational center of the base end side of the cam portion 56 and extends in a longitudinal direction of the pull tab 5, and a straight line B, which passes through a radial center of the leading end side of the cam portion 56 and the rotational center of the base end side thereof, are intersected with each other at a predetermined angle.

The locking pawl 6 according to the present embodiment has elasticity and at one end thereof, includes a pawl portion 61 capable of being inserted into and removed from the element guide passage 28 through the pawl hole 36 of the slider body 2. Also, on the other end, a hook portion 62 is provided to be fitted into the recessed portion 33 of the insertion groove 32 of the slider body 2. In addition, a cover portion 63 having a generally U-shaped cross section is arranged between the pawl portion 61 and the hook portion 62 of the locking pawl 6 to cover the connection rod 53 and the cam portion 56 of the pull tab 5 at the upper side thereof. Further, the cover portion 63 has a top plate portion 63*a* provided between the one end and the other end of the locking pawl 6 to be capable of coming in contact with the cam portion 56, and each of one end and the other end of the cover portion 63 is bent relative to the top plate portion 63*a*.

The cover portion 63 of the locking pawl 6 has a width dimension smaller than a distance between the right and left pull tab holding portions 31 arranged on the slider body 2 and also larger than the groove width of the insertion groove 32 formed in the slider body 2. In addition, a part of the locking pawl 6, which is located more toward the other end than the cover portion 63, has a width dimension smaller than the groove width of the insertion groove 32 formed in the slider body 2.

Hereinafter, a method of manufacturing the slide fastener slider 1 of the present embodiment constituted of the slider body 2, the pull tab 5 and the locking pawl 6 as described above will be described.

First, a mounting process of the slide fastener slider 1 will be described.

The connection rod 53 of the pull tab 5 is inserted between the front and rear protrusions 31*a* provided in each of the right and left pull tab holding portions 31 of the slider body 2, and then the front and rear protrusions 31*a* are bent and crimped in directions approaching each other in a state where the pull tab 5 is completely laid down toward the rear mouth 27. Thus, the pull tab 5 is held on the slider body 2 to be pivotable about the connection rod 53.

Subsequently, the locking pawl 6 is installed on the slider body 2 with the pull tab 5 held thereon. At this time, the pawl portion 61 of the locking pawl 6 is inserted through the pawl hole 36 of the slider body 2, the hook portion 62 is fitted into the recessed portion 33, and also the cover portion 63 of the locking pawl 6 is arranged to cover the connection rod 53 and the cam portion 56 of the pull tab 5 at the upper side thereof. Thus, the locking pawl 6 is arranged at a predetermined position on the slider body 2.

Then, the fixation portions 34 arranged on the slider body 2 are bent and crimped inward, so that in a state where the pawl portion 61 of the locking pawl 6 is inserted in the pawl hole 36, the other end of the locking pawl 6 is fixed in a crimping manner by the fixation portions 34 while having a predetermined clearance. By performing such operations, the slide fastener slider 1 of the present embodiment as shown in FIG. 2 is assembled.

Next, a surface treatment process of the slide fastener slider 1 will be described.

In the preset embodiment, plating as a surface treatment can be performed in a state where the body 2, the pull tab 5 and the locking pawl 6 are assembled. The surface treatment process of the present embodiment is performed by putting a plurality of sider fastener sliders 1, into which the body 2, the pull tab 5 and the locking pawl 6 have been already assembled, in a barrel provided with a plurality of small holes, immersing the barrel into a plating solution and then plating the sliders while rotating the barrel.

Alternatively, the surface treatment is not limited to plating, but may be painting and the like.

Next, operations of the slider 1 of the present embodiment assembled as described above will be described.

Figure 6:
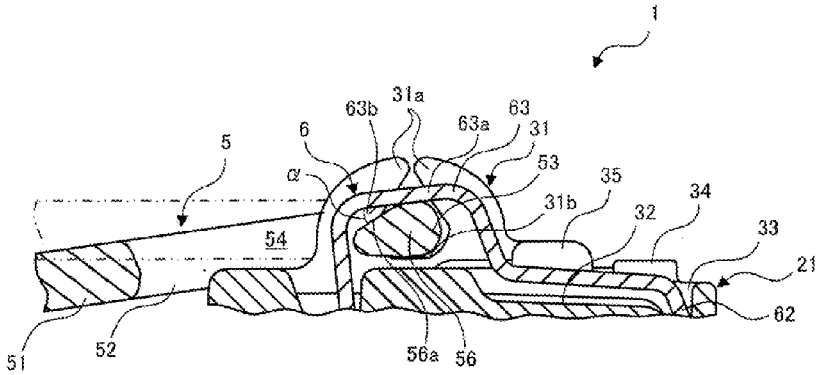
FIG. 6 is an enlarged sectional view, as taken along the front and rear direction, showing the vicinity of a cam portion in the state where the pull tab is completely laid down toward the rear mouth according to the slider of the present embodiment.

FIG. 6 is an enlarged sectional view, as taken along the front and rear direction, showing the vicinity of the cam portion in the state where the pull tab is completely laid down toward the rear mouth according to the slider of the present embodiment.

Figure 8:
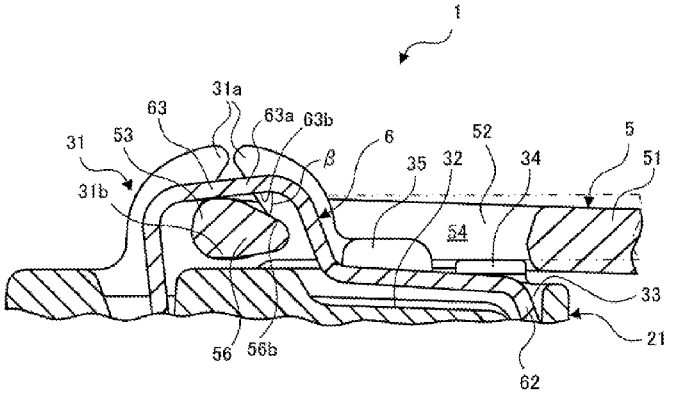
FIG. 8 is an enlarged sectional view, as taken along the front and rear direction, showing the vicinity of the cam portion in the state where the pull tab is completely laid down toward shoulder mouths according to the slider of the present embodiment.

As shown in FIGS. 6 and 8, the slider 1 has a rotatable region ranging from laid-down positions where the pull tab 5 fixed on the slider body 2 is laid down toward the shoulder mouths 26 and the rear mouth 27 of the slider body 2, to a stood-up position where the pull tab 5 is stood up from the laid-down positions by pivotal operation of the connection rod 53 of the pull tab 5. Herein, the stood-up position refers to any one position within a range in which the pull tab 5 can be pivoted, and thus does not refer to a specific position, unlike the laid-down positions, where the pull tab 5 is completely laid down. In FIG. 6, the pull tab 5 is laid down toward the rear mouth 27 of the slider body 2, so that the cam portion 56 formed on the connection rod 53 of the pull tab 5 can be oriented in a direction generally parallel to the upper surface of the upper blade 21. Herein, the phrase "toward the shoulder mouths 26" refers a direction from the connection rod 53 toward the shoulder mouths 26 shown in FIG. 3, and the phrase "toward the rear mouth 27" refers to a direction from the connection rod 53 toward the rear mouth 27 shown in FIG. 3.

Also, according to the present embodiment, at the laid-down position where the pull tab is completely laid down toward the rear mouth 27 relative to the slider body 2, an angle $\alpha$ between the first inclined surface 56*a* of the cam portion 56 and the lower surface 63*b* of the top plate portion 63*a* of the cover portion 63 is set in a range of $10° \leq \alpha \leq 35°$. Alternatively, when the pull tab is completely laid down toward the rear mouth 27 relative to the slider body 2, the angle $\alpha$ between the first inclined surface 56*a* of the cam portion 56 and the lower surface 63*b* of the top plate portion 63*a* of the cover portion 63 may be set in a range of $10° \leq \alpha \leq 25°$.

If the angle $\alpha$ is smaller than the above set range, a surface treatment material is difficult to permeate between the pull tab and the body and thus there is a possibility that a poor surface treatment is occurred. Contrarily, if the angle $\alpha$ is greater than the above set range, a movable range of the locking pawl 6 is decreased and operability is deteriorated.

In other words, the angle $\alpha$ is an angle, by which the pull tab 5 is rotatable from the laid-down position where the pull tab is laid down toward the rear mouth 27, to a state immediately after the first inclined surface 56*a* is abutted against the locking pawl 6 (i.e., a state of FIG. 7), and is also referred to as a second rotatable region.

Herein, if the angle $\alpha$ is set to be greater so that the movable range of the locking pawl 6 is deceased, an operation of inserting or removing the pawl portion 61 of the locking pawl 6 is delayed. Therefore, as one measure for setting the angle $\alpha$ to be wider while preventing the movable range of the locking pawl 6 from being decreased, the present embodiment is preferably configured so that, assuming that an angle when the pull tab is arranged parallel to the upper surface of the upper blade 21 is 0°, the pull tab 5 can be rotated downward about 5° to 6° relative to the upper surface of the upper blade 21 which is located toward the rear mouth 27.

Due to this configuration, the pull tab 5 can be configured to be freely rotated up to about 35° from the laid-down position, where the pull tab is completely laid down toward the rear mouth 27 relative to the slider body 2, until the pawl portion 61 starts to be operated, which is herein referred to as a playing region meaning a region in which the pull tab is rotatable over a predetermined range without exerting any load.

At this time, the pull tab 5 is in a state where only a part of the connection rod 53 is abutted against the cover portion 63 of the locking pawl 6 and the camp portion 56 does not interfere with the cover portion 63 of the locking pawl 6. Namely, the playing region is formed between the first inclined surface 56*a* of the cam portion 56 and the cover portion 63 of the locking pawl 6. The playing region is set by the angle $\alpha$ between the first inclined surface 56*a* and the lower surface 63*b* of the top plate portion 63*a* of the cover portion 63 as described above.

Accordingly, even if the pull tab 5 rotates within the playing region, the cover portion 63 of the locking pawl 6 is not lifted by the cam portion 56. In addition, the pawl portion 61 of the locking pawl 6 is kept protruding into the element guide passage 28, shown in FIG. 3, through the pawl hole 36.

Thus, when a slide fastener is constructed by inserting elements rows of a fastener chain through the slider 1 of the present embodiment, the pull tab 5 is laid down toward the rear mouth 27 of the slider body 2 so that the pawl portion 61 of the locking pawl 6 protrudes into the element guide passage 28, shown in FIG. 3, to be locked on the element rows, thereby keeping the slider 1 at a stopped position relative to the element rows.

Figure 7:
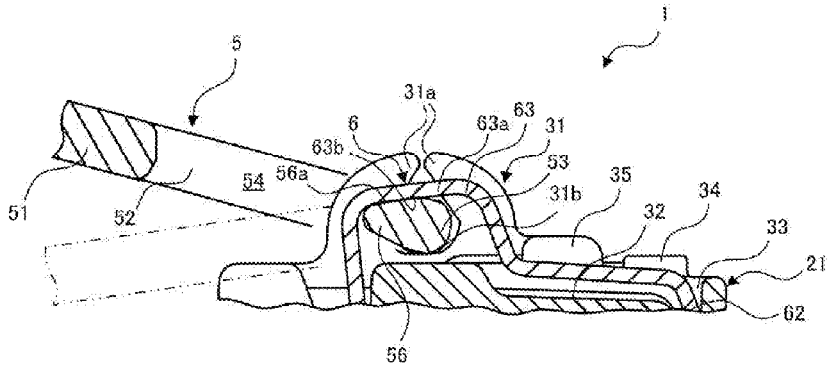
FIG. 7 is an enlarged sectional view, as taken along the front and rear direction, showing the vicinity of the cam portion when the pull tab is stood up from the state, where the pull tab is completely laid down toward the rear mouth so that the cam portion is abutted against a locking pawl according to the slider of the present embodiment.

FIG. 7 is an enlarged sectional view, as taken along the front and rear direction, showing the vicinity of the cam portion when the pull tab is stood up from the laid-down position, where the pull tab is completely laid down toward the rear mouth, to the stood-up position so that the cam portion is abutted against the locking pawl, according to the slider of the first embodiment. Meanwhile, the stood-up position in FIG. 7 is a state immediately after the cam portion is abutted against the locking pawl 6, corresponding to a state where no load is exerted on the locking pawl 6.

When the pull tab 5 is slightly lifted from the state shown in FIG. 6, the pawl portion 61 of the locking pawl 6 is not removed from the element guide passage 28, so far as the pull tab 5 is pivoted within the playing region where the pull tab is rotatable over a predetermined range without exerting any load on the locking pawl 6. Namely, the pull tab 5 can be freely rotated within the playing region ranging from the laid-down position, where the pull tab 5 is laid down toward the rear mouth as shown in FIG. 6, to the stood-up position, where the first inclined surface 56*a* of the cam portion 56 is abutted against the cover portion 63 of the locking pawl 6 as shown in FIG. 7.

Subsequently, if the pull tab 5 is further lifted from the state, where the first inclined surface 56*a* of the cam portion 56 is abutted against the cover portion 63 of the locking pawl 6 as shown in FIG. 7, to be stood up in a direction perpendicular to the upper blade 21, the pull tab 5 is inclined at an angle exceeding a predetermined inclination angle relative to the upper surface of the upper blade 21. Then, the cam portion 56 of the pull tab 5 intervenes with the cover portion 63 of the locking pawl 6, so that the locking pawl 6 is elastically deformed and the cover portion 63 of the locking pawl 6 is lifted by the first inclined surface 56*a* of the cam portion 56. Thus, the pawl portion 61 of the locking pawl 6 is removed from the element guide passage 28 shown in FIG. 3. As a result, the slider 1 is allowed to be moved over elements, not shown.

FIG. 8 is an enlarged sectional view, as taken along the front and rear direction, showing the vicinity of the cam portion in the state where the pull tab is completely laid down toward the shoulder mouths according to the slider of the first embodiment.

As shown in FIG. 8, the slider 1 is configured to allow the cam portion 56 formed on the connection rod 53 of the pull tab 5 to be oriented in a direction generally parallel to the upper surface of the upper blade 21 by laying down the pull tab 5 toward the shoulder mouths 26, shown in FIG. 1, of the slider body 2.

Also, in the present embodiment, at the laid-down position where the pull tab is completely laid down toward the shoulder mouths 26 relative to the slider body 2, an angle $\beta$ between the second inclined surface 56*b* of the cam portion 56 and the lower surface 63*b* of the top plate portion 63*a* of the cover portion 63 is set in a range of $10° \leq \beta \leq 35°$. Alternatively, when the pull tab is completely laid down toward the shoulder mouths 26 relative to the slider body 2, the angle $\beta$ between the second inclined surface 56*b* of the cam portion 56 and the lower surface 63*b* of the top plate portion 63*a* of the cover portion 63 may be set in a range of $10° \leq \beta \leq 25°$.

If the angle $\beta$ is smaller than the above set range, a surface treatment material is difficult to permeate between the pull tab and the body and thus there is a possibility that a poor surface treatment is occurred. Contrarily, if the angle $\beta$ is greater than the above set range, a movable range of the locking pawl 6 is decreased and operability is deteriorated.

In other words, the angle $\beta$ is an angle, by which the pull tab 5 can rotate from the laid-down position, where the pull tab is laid down toward the shoulder mouths 26, to a state immediately after the second inclined surface 56*b* is abutted against the locking pawl 6 (i.e., a state of FIG. 9), and is also referred to as a third rotatable region. Meanwhile, a region, in which the cover portion 63 can be moved by the cam portion 56, corresponding to between the third rotatable region and the second rotatable region is referred to as a first rotatable region.

Also, for the same reason as the case of the angle α, the present embodiment is preferably configured so that, assuming that an angle of the upper surface of the upper blade 21 is 0°, the pull tab 5 can be rotated downward about 2° to 3° relative to when the pull tab is arranged parallel to the upper surface of the upper blade 21 which is located toward the shoulder mouths 26. Namely, the pull tab 5 can be configured to be freely rotated up to about 35°, as a playing region, from the laid-down position, where the pull tab is completely laid down toward the shoulder mouths 26 relative to the slider body 2, until the pawl portion 61 starts to be operated.

At this time, the pull tab 5 is in a state where only a part of the connection rod 53 is abutted against the cover portion 63 of the locking pawl 6 and the camp portion 56 does not interfere with the cover portion 63 of the locking pawl 6. Namely, the playing region is formed between the second inclined surface 56*b* of the cam portion 56 and the cover portion 63 of the locking pawl 6. The playing region is set by the angle α between the first inclined surface 56*a* and the lower surface 63*b* of the top plate portion 63*a* of the cover portion 63 as described above. Accordingly, even if the pull tab 5 rotates within the playing region, the cover portion 63 of the locking pawl 6 is not lifted by the cam portion 56. In addition, the pawl portion 61 of the locking pawl 6 is kept protruding into the element guide passage 28, shown in FIG. 3, through the pawl hole 36.

Thus, when a slide fastener is constructed by inserting elements rows of a fastener chain through the slider 1 of the present embodiment, the pull tab 5 is laid down toward the shoulder mouths 26 of the slider body 2 so that the pawl portion 61 of the locking pawl 6 protrudes into the element guide passage 28 to be locked on the element rows, thereby keeping the slider 1 at a stopped position relative to the element rows.

Figure 9:
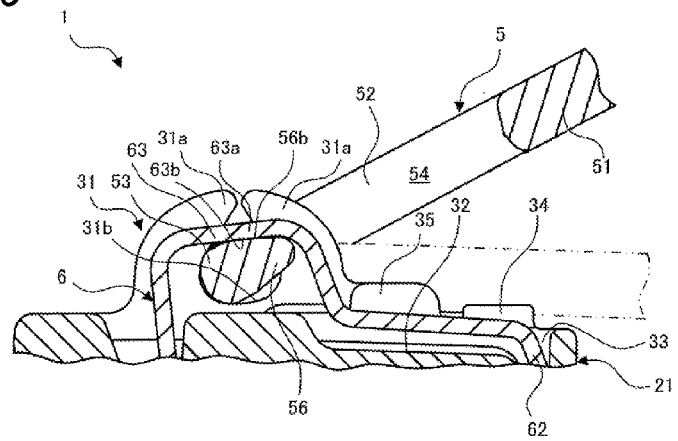
FIG. 9 is an enlarged sectional view, as taken along the front and rear direction, showing the vicinity of the cam portion when the pull tab is stood up from the state, where the pull tab is completely laid down toward the shoulder mouths so that the cam portion is abutted against the locking pawl according to the slider of the present embodiment.

FIG. 9 is an enlarged sectional view, as taken along the front and rear direction, showing the vicinity of the cam portion when the pull tab is stood up from the laid-down position, where the pull tab is completely laid down toward the shoulder mouths, so that the cam portion is abutted against the locking pawl, according to the slider of the first embodiment. Meanwhile, the stood-up position in FIG. 9 is a state immediately after the cam portion is abutted against the locking pawl 6, corresponding to a state where no load is exerted on the locking pawl 6.

When the pull tab 5 is slightly lifted from the state shown in FIG. 8, the pawl portion 61 of the locking pawl 6 is not removed from the element guide passage 28, so far as the pull tab 5 is pivoted within the playing region where the pull tab is rotatable over a predetermined range without exerting any load on the locking pawl 6. Namely, the pull tab 5 can be freely rotated within the playing region ranging from the laid-down position, where the pull tab 5 is laid down toward the shoulder mouths 26 as shown in FIG. 8, to a stood-up position, where the second inclined surface 56*b* of the cam portion 56 is abutted against the cover portion 63 of the locking pawl 6 as shown in FIG. 9.

Subsequently, if the pull tab 5 is further lifted from the state, where the first inclined surface 56*a* of the cam portion 56 is abutted against the cover portion 63 of the locking pawl 6 as shown in FIG. 9, to be stood up in a direction perpendicular to the upper blade 21, the pull tab 5 is inclined at an angle exceeding a predetermined inclination angle relative to the upper surface of the upper blade 21. Then, the cam portion 56 of the pull tab 5 intervenes with the cover portion 63 of the locking pawl 6, so that the locking pawl 6 is elastically deformed and the cover portion 63 of the locking pawl 6 is lifted by the second inclined surface 56*b* of the cam portion 56. Thus, the pawl portion 61 of the locking pawl 6 is removed from the element guide passage 28 shown in FIG. 3. As a result, the slider 1 is allowed to be moved over elements, not shown.

As described above, according to the present embodiment, there is provided a slide fastener slider 1 including a slider body 2 having upper and lower blades 21 and 22 connected at front ends thereof to each other by a connecting post 23 and a Y-shaped element guide passage 28 arranged between the upper and lower blades 21 and 22 to extend from shoulder mouths 26, which are located toward the connecting post 23, to a rear mouth 27 opposite to the connecting post 23; a pull tab 5 having a body 51 for operating the slider body 2, a pair of arm portions 52 provided to extend from one end of the body 51 and a connection rod 53 for connecting the pair of the arm portions 52; and a locking pawl 6 arranged on the upper blade 21 and having a pawl portion 61 at one end thereof and a cover portion 63 provided between the one end and the other end to cover at least a part of the connection rod 53 of the pull tab 5; wherein the pull tab 5 is pivotally held on the upper blade 21 at the connecting rod 53; wherein the locking pawl 6 is fixed on the slider body 2 at the other end; wherein the pull tab 5 has laid-down positions, where the pull tab 5 is laid down toward the shoulder mouths 26 and rear mouth 27 of the slider body 2, and a rotatable region, where the pull tab 5 is stood up from the laid-down positions to a stood-up position by pivotal operation of the connection rod 53; wherein, within the rotatable region of the pull tab 5, the locking pawl 6 is elastically deformed to move the cover portion 63, and the pawl portion 61 is arranged to be inserted into and removed from the element guide passage 28 in accordance with movement of the cover portion 63; and wherein when the pull tab 5 is completely laid down toward the shoulder mouths 26 and rear mouth 27 relative to the slider body 2, the pull tab 5 has respective regions in which the pull tab 5 is rotatable over a predetermined angle without exerting any load on the locking pawl 6. Accordingly, even if a surface treatment is performed in a state where the locking pawl 6 and the pull tab 5 are assembled with the body 2, the pull tab 5 can be spaced from the body 2 within such playing regions, so that a surface treatment material can permeate between the pull tab 5 and the body 2, thereby allowing the surface treatment to be accurately performed.

Also, the connection rod 53 of the pull tab 5 has a cam portion 56 formed to protrude from a base end side thereof toward a leading end side, the cam portion 56 has first and second inclined surfaces 56*a* and 56*b*, respectively, on front and back sides of the pull tab 5, and the first and second inclined surfaces 56*a* and 56*b* are inclined in such a direction that the inclined surfaces approach each other from the base end side toward the leading end side, wherein when the pull tab 5 is completely laid down toward the rear mouth 27 relative to the slider body 2, a predetermined angle is formed between the first inclined surface 56*a* of the cam portion 56 and a lower surface 63*b* of a top plate portion 63*a* of the cover portion 63 of the locking pawl 6, and when the pull tab 5 is completely laid down toward the shoulder mouths 26 relative to the slider body 2, a predetermined angle is formed between the second inclined surface 56*b* of the cam portion 56 and the lower surface 63*b* of the top plate portion 63*a* of the cover portion 63 of the locking pawl 6. Accordingly, the surface treatment can be more accurately performed.

Further, the cam portion is formed so that a straight line, which passes through a rotational center of the base end side of the cam portion 56 and extends in a longitudinal direction of the pull tab 5, and a straight line, which passes through a radial center of the leading end side of the cam portion 56 and the rotational center of the base end side thereof, are intersected with each other. Accordingly, the playing regions of the pull tab 5 can be increased, thereby allowing the surface treatment to be more accurately performed.

Also, a mounting portion 31*b* having an upper surface positioned above the upper surface of the upper blade 21 is formed on the upper surface of the upper blade 21, and the connection rod 53 of the pull tab 5 is installed on the slider body 2 to be abutted against the upper surface of the mounting portion 31*b*. Accordingly, an elastically deformable region of the locking pawl 6, i.e., a region in which the pawl portion 61 is allowed to be inserted into or removed from the element guide passage 28 can be kept large, so that the playing region of the pull tab 5 can be increased and also a slider in which a stopping function of the locking pawl 6 is not damaged can be provide.

Further, stepped portions 38 having a stepped surface 38*a* are formed on respective side ends of the upper surface of the upper blade 21, which are located toward the rear mouth 27, the stepped portions 38 are configured to have a stepped bottom surface 38*a* positioned below the upper surface of the upper blade 21, and when the pull tab 5 is laid down toward the rear mouth 7, the pull tab 5 and the slider body 2 have a relationship that the pull tab 5 is abutted against the upper surface of the upper blade 21 and gaps between the stepped bottom surfaces 38*a* and the pull tab 5 are created. Accordingly, an elastically deformable region of the locking pawl 6, i.e., a region in which the pawl portion 61 is allowed to be inserted into or removed from the element guide passage 28 can be kept large, so that the playing region of the pull tab 5 can be increased and also a slider in which a stopping function of the locking pawl 6 is not damaged can be provide.

Further, at the laid-down position where the pull tab 5 is completely laid down toward the rear mouth 27 relative to the slider body 2, the angle $\alpha$ between the first inclined surface 56*a* of the cam portion 56 and the lower surface 63*b* of the top plate portion 63*a* of the cover portion 63 of the locking pawl 6 is $10° < \alpha \leq 35°$, and at the laid-down position where the pull tab 5 is completely laid down toward the shoulder mouths 26 relative to the slider body 2, the angle $\beta$ between the second inclined surface 56*b* of the cam portion 56 and the lower surface 63*b* of the top plate portion 63*a* of the cover portion 63 of the locking pawl 6 is $10° < \beta \leq 35°$. Accordingly, when a surface treatment is performed after an assembling process, a slider in which a poor surface treatment is hardly occurred can be provided. Also, the slider ensures a movable range of the locking pawl 6 and thus has a good operability.

Further, the pull tab 5 is configured to be rotated relative to the slider body 2 within a range of 0° or more and 5° or less from a stoop-up position, where a longitudinal direction of the pull tab 5 is parallel to the upper surface of the upper blade 21, toward the respective laid-down positions. Accordingly, the movable range of the locking pawl 6 can be ensured.

Also, according to the present embodiment, there is provided a method of manufacturing a slide fastener slider, the slide fastener slider including: a slider body 2 having upper and lower blades 21 and 22 connected at front ends thereof to each other by a connecting post 23 and a Y-shaped element guide passage 28 arranged between the upper and lower blades 21 and 22 to extend from shoulder mouths 26, which are located toward the connecting post 23, to a rear mouth 27 opposite to the connecting post 23; a pull tab 5 having a body 51 for operating the slider body 2, a pair of arm portions 52 provided to extend from one end of the body 51 and a connection rod 53 for connecting the pair of the arm portions 52; and a locking pawl 6 arranged on the upper blade 21 and having a pawl portion 61 at one end thereof and a cover portion 63 provided between the one end and the other end to cover at least a part of the connection rod 53 of the pull tab 5; wherein the pull tab 5 has laid-down positions, where the pull tab 5 is laid down toward the shoulder mouths 26 and rear mouth 27 of the slider body 2, and a rotatable region, where the pull tab 5 is stood up from the laid-down positions to a stood-up position by pivotal operation of the connection rod 53; and wherein the method includes: a mounting step of mounting the pull tab 5 and the locking pawl 6 on the slider body 2, so that within the rotatable region of the pull tab 5, the pull tab 5 has a first rotatable region in which the locking pawl 6 is elastically deformed to move the cover portion 63, a second rotatable region between the first rotatable region and the laid-down position toward the shoulder mouths, where the pull tab 5 is rotatable over a predetermined angle without exerting any load on the locking pawl 6, and a third rotatable region between the first rotatable region and the laid-down position toward the rear mouth, where the pull tab 5 is rotatable over a predetermined angle without exerting any load on the locking pawl 6; and a surface treatment step of surface-treating the slide fastener slider having the slider body 2, the pull tab 5 and the locking pawl 6 mounted during the mounting step.

Accordingly, the surface treatment can be performed in a state where the body 2 is assembled with the pull tab 5 and the locking pawl 6, so that a process of mounting the pull tab on the slider body and a process of mounting the locking pawl on the slider body can be integrated into a single process. Therefore, costs which would otherwise have been incurred to purchase respective equipment for performing each individual process, spaces which would have been required to dispose the respective equipment, and working hours which would have been taken for each individual process are not required.

Also, the locking pawl 6 together with the body 2 and the pull tab 5 can be surface-treated. Therefore, the body 2, the pull tab 5 and the locking pawl 6 have the same appearance, thereby providing a good decorativeness.

Further, according to the present embodiment, the locking pawl 6 together with the body 2 and the pull tab 5 can be surface-treated at one time after crimping, so that flaws occurred when the protrusions 31*a* and the fixation portions 34 are crimped or the like can be covered by the surface treatment. Accordingly, the body 2, the pull tab 5 and the locking pawl 6 have the same appearance, thereby providing a good decorativeness.

In other words, according to the present embodiment, the slide fastener slider 1 can be provided in which assembling of the slider body 2, the locking pawl 6 and the pull tab 5 can be quickly performed at a low cost and in space-saving manner and also decorativeness can be enhanced.

In the foregoing, although various embodiments of the present invention have been described, the invention is not limited to these embodiments and accordingly any other embodiments configured by appropriately combining configurations of these embodiments are also intended to be fallen within the scope of the invention.

DESCRIPTION OF REFERENCE NUMERALS

1 Slider
2 Slider Body
5 Pull Tab
6 Locking pawl
21 Upper Blade
22 Lower Blade
23 Connecting Post
24 Upper Flange Portion
25 Lower Flange Portion
26 Shoulder Mouth
27 Rear Mouth
28 Element Guide Passage
31 Pull Tab Holding Portion
31*a* Protrusion
32 Insertion Groove
33 Recessed Portion
34 Fixation Portion
34*a* Upper End
35 Raised Portion
36 Pawl Hole
37 First Stepped Portion
38 Second Stepped Portion
38*a* Stepped Bottom Surface
51 Pull Tab Body
52 Arm Portion
53 Connection Rod
54 Opening Window Portion
54*a* Side Wall Portion
56 Cam Portion
56*a* First Inclined Surface
56*b* Second Inclined Surface
61 Pawl Portion
62 Hook Portion
63 Cover Portion
63*a* Top Plate Portion
63*b* Lower Surface

The invention claimed is:

1. A slide fastener slider, comprising:

a slider body in which upper and lower blades are connected at front ends thereof to each other by a connecting post and a Y-shaped element guide passage is arranged between the upper and lower blades to extend from shoulder mouths located at a side of the connecting post to a rear mouth located at a side opposite to the connecting post;

a pull tab having a body for operating the slider body, a pair of arm portions provided to extend from one end of the body and a connection rod connecting the pair of arm portions; and a locking pawl arranged on the upper blade and having a pawl portion at one end thereof and a cover portion provided between the one end and another end to cover at least a part of the connection rod of the pull tab, wherein the pull tab is pivotally held on the upper blade at the connection rod thereof, wherein the locking pawl is fixed on the slider body at the another end thereof, wherein the pull tab has a rotatable region including laid-down positions where the pull tab is laid down toward the shoulder mouths and the rear mouth of the slider body, and a stood-up position where the pull tab is stood up from the laid-down positions by pivotal operation of the connection rod, wherein, within the rotatable region of the pull tab, the locking pawl is elastically deformed to move the cover portion, and the pawl portion is arranged to be inserted into and removed from the element guide passage in accordance with movement of the cover portion, and wherein when the pull tab is completely laid down toward the shoulder mouths and the rear mouth relative to the slider body, the pull tab has respective regions in which the pull tab is rotatable over a predetermined angle without exerting any load on the locking pawl.

2. The slide fastener slider according to claim 1, wherein the connection rod of the pull tab has a cam portion formed to protrude from a base end side thereof toward a leading end side;

wherein the cam portion has first and second inclined surfaces, respectively, on front and back sides of the pull tab;

wherein the first and second inclined surfaces are inclined in such a direction that the inclined surfaces approach each other from the base end side toward the leading end side;

wherein when the pull tab is completely laid down toward the rear mouth relative to the slider body, the predetermined angle is formed between the first inclined surface of the cam portion and a lower surface of a top plate portion of the cover portion of the locking pawl; and wherein when the pull tab is completely laid down toward the shoulder mouths relative to the slider body, the predetermined angle is formed between the second inclined surface of the cam portion and the lower surface of the top plate portion of the cover portion of the locking pawl.

3. The slide fastener slider according to claim 2, wherein the cam portion is configured to have a circular arc-shaped leading end portion connecting the first and second inclined surfaces; and wherein the cam portion is formed so that a straight line, which passes through a rotational center of the base end side of the cam portion and extends in a longitudinal direction of the pull tab, and a straight line, which passes through a radial center of the leading end side of the cam portion and the rotational center of the base end side thereof, are intersected with each other.

4. The slide fastener slider according to claim 2, wherein a mounting portion having an upper surface positioned above an upper surface of the upper blade is formed on the upper surface of the upper blade; and wherein the connection rod of the pull tab is installed on the slider body to be abutted against the upper surface of the mounting portion.

5. The slide fastener slider according to claim 2, wherein at the laid-down position where the pull tab is completely laid down toward the rear mouth relative to the slider body, an angle $\alpha$ between the first inclined surface of the cam portion and the lower surface of the top plate portion of the cover portion of the locking pawl is $10° < \alpha \leq 35'$; and wherein at the laid-down position where the pull tab is completely laid down toward the shoulder mouths relative to the slider body, an angle $\beta$ between the second inclined surface of the cam portion and the lower surface of the top plate portion of the cover portion of the locking pawl is $10° < \beta \leq 35°$.

6. The slide fastener slider according to claim 5, wherein the pull tab is configured to be rotatable relative to the slider body within a range of 0° or more and 5° or less from a stoop-up position, where a longitudinal direction of the pull tab is parallel to an upper surface of the upper blade, toward the respective laid-down positions.

7. The slide fastener slider according to claim 2, wherein stepped portions having a stepped surface are formed on respective side ends of an upper surface of the upper blade, which are located toward the rear mouth;

wherein the stepped portions are configured to have stepped bottom surfaces positioned below the upper surface of the upper blade; and wherein when the pull tab is laid down toward the rear mouth, the pull tab and the slider body have a relationship that the pull tab is abutted against the upper surface of the upper blade and gaps between the stepped bottom surfaces and the pull tab are created.

8. The slide fastener slider according to claim 1, wherein the slider body, the pull tab and the locking pawl have surfaces subjected to a same surface treatment.

9. A method of manufacturing a slide fastener slider, the slide fastener slider comprising:

a slider body in which upper and lower blades are connected at front ends thereof to each other by a connecting post and a Y-shaped element guide passage is arranged between the upper and lower blades to extend from shoulder mouths located at a side of the connecting post to a rear mouth located at a side opposite to the connecting post;

a pull tab having a body for operating the slider body, a pair of arm portions provided to extend from one end of the body and a connection rod or connecting the pair of the arm portions; and a locking pawl arranged on the upper blade and having a pawl portion at one end thereof and a cover portion provided between the one end and another end to cover at least a part of the connection rod of the pull tab, wherein the pull tab has a rotatable region including laid-down positions where the pull tab is laid down toward the shoulder mouths and the rear mouth of the slider body, and a stood-up position where the pull tab is stood up from the laid-down positions by pivotal operation of the connection rod, the method comprising:

a mounting step of mounting the pull tab and the locking pawl on the slider body so that within the rotatable region of the pull tab, the pull tab has:

a first rotatable region in which the locking pawl is elastically deformed to move the cover portion;

a second rotatable region between the first rotatable region and the laid-down position toward the shoulder mouths, where the pull tab is rotatable over a predetermined angle without exerting any load on the locking pawl; and a third rotatable region between the first rotatable region and the laid-down position toward the rear mouth, where the pull tab is rotatable over a predetermined angle without exerting any load on the locking pawl; and a surface treatment step of surface-treating the slide fastener slider having the slider body, the pull tab and the locking pawl mounted during the mounting step.

* * * * *